United States Patent [19]

Boyarina et al.

[11] Patent Number: 4,731,805

[45] Date of Patent: Mar. 15, 1988

[54] ROTARY ANODE FOR AN X-RAY TUBE AND AN X-RAY TUBE HAVING SUCH ANODE

[76] Inventors: Maiya F. Boyarina, ulitsa Trefoleva, 15, kv. 92; Vladimir G. Vildgrube, Svetlanovsky prospekt, 44, korpus 2, kv. 144; Jury S. Sergeev, prospekt Morisa Toreza, 30, kv. 24; Oleg V. Filatov, ulitsa Kuibysheva, 1/5, kv. 21; Lev G. Andruschenko, prospekt Stachek, 216, kv. 60; Jury N. Zelenov, bulvar Novatorov, 22, kv. 5; Valery N. Kupriyanov, Serebristy bulvar, 26, kv. 529; Elena I. Taubkina, prospekt Morisa Toreza, 24, kv. 133, all of Leningrad, U.S.S.R.

[21] Appl. No.: 829,650

[22] PCT Filed: Jun. 8, 1984

[86] PCT No.: PCT/SU84/00030

§ 371 Date: Jan. 28, 1986

§ 102(e) Date: Jan. 28, 1986

[87] PCT Pub. No.: WO86/00171

PCT Pub. Date: Jan. 3, 1986

[51] Int. Cl.[4] ..... H01J 35/10; H01J 35/08

[52] U.S. Cl. ..... 378/144; 378/143; 378/125; 378/129

[58] Field of Search ..... 378/129, 125, 144, 143; 313/355

[56] References Cited

U.S. PATENT DOCUMENTS

| | | | |
|---|---|---|---|
| 3,737,699 | 6/1973 | Gager | 378/144 |
| 4,271,372 | 6/1981 | Geldner | 378/144 |
| 4,320,323 | 3/1982 | Magendans et al. | 378/144 |
| 4,637,042 | 1/1987 | Braun | 378/143 |

FOREIGN PATENT DOCUMENTS

| | | |
|---|---|---|
| 2443354 | 4/1979 | Fed. Rep. of Germany . |
| 2521776 | 8/1983 | France . |

*Primary Examiner*—Carolyn E. Fields
*Assistant Examiner*—Joseph A. Hynds
*Attorney, Agent, or Firm*—Fleit, Jacobson, Cohn & Price

[57] ABSTRACT

A rotary anode for an X-ray tube is in the form of a disc (1) the surface of which has, at least partially, a blackening coating (2). The latter is in the form of a sintered porous composition of titanium grains, mainly of the dendritic structure, of a size from 0.5 to 150 μm, and at least one high-melting metal having a melting point above 2500° C., the quantity the high-melting metal in the composition being from 5 to 60% by mass.

3 Claims, 2 Drawing Figures

ROTARY ANODE FOR AN X-RAY TUBE AND AN X-RAY TUBE HAVING SUCH ANODE

FIELD OF THE ART

The invention relates to X-ray tubes and, in particular, it deals with a rotary anode for an X-ray tube and with an X-ray tube having a rotary anode.

STATE OF THE ART

Known in the art is a rotary anode for an X-ray tube, comprising a disc having a blackening coating on the surface consisting of aluminum oxide and titanium dioxide (cf. FRG Pat. No. 2443345, Apr. 5, 1979), the coating being deposited to the disc surface of the method of plasma spraying.

The oxide coating features a low radiation factor which is about 0.3 because the oxides used for producing the coating are of white colour and an increase in the radiation factor of the anode having such a coating is only due to the roughness of fused particles. In addition, the oxide coating exhibits a low heat conductance.

To produce a strong coating of oxides, methods other than the plasma spraying method cannot be used. The use of this technique requires, however, use of sophisticated equipment and high temperatures which are above the melting point of the coating material so that the process of coating application is accompanied by breaking of structure and fusion of powder particles, hence, by impairment of characteristics of both raw materials and the resultant coating.

Internal stresses on the surface of the rotary anode caused by heat shocks during application of the coating and owing to a substantial difference between coefficients of thermal expansion of the materials of the disc and coating result in cracks appearing in the coating and in particles of the coating separating therefrom during rotation of the anode.

During operation, the oxide coating is capable of releasing oxygen which is a part of the oxides thus creating unfavorable conditions for operation of a cathode.

In view of the abovesaid, use of the prior art anode in X-ray tubes results in a comparatively low power and short service life of X-ray tubes.

Service life was prolonged and power of X-ray tubes were increased by improving the radiation factor of the surface of the rotary anode during operation of the X-ray tube through the employment of a rotary anode having a disc made of a molybdenum alloy containing carbon and having a focus path region of tunsten or a tungsten alloy having a double-layer blackening coating on its surface. The outer, basic layer of the surface in this prior art anode consists of several oxides or of a mixture of several metals and several oxides, and the intemediate layer disposed between the disc and the basic layer, which is 10 to 200 μm thick, is made of molybdenum and/or tungsten (cf. French patent application No. 2521776, publ. Aug. 19, 1983).

Properties of the coating (strength and radiation factor) in such anode were stabilized during operation of the X-ray tube owing to the provision of the intermediate high-melting metal which partly compensates for a difference between physico-mechanical properties of the materials of the disc and basic coating layer.

In spite of advantages of this design, it does not make possible to improve characteristics of X-ray tubes having such anode to a substantial extent because of the drawbacks inherent in rotary anodes having blackening coating containing the oxides as described above.

In addition, the process of manufacture of the prior art anode is complicated since it involves application of several layers and, hence, is highly expensive.

SUMMARY OF THE INVENTION

The invention is based on the problem of providing a rotary anode for an X-ray tube having a coating with a composition and structure which feature high mechanical strength and radiation factor, also providing an X-ray tube having such anode, the X-ray tube being such that its higher power and longer service life should be ensured in operation.

This problem is solved by that in a rotary anode for an X-ray tube, comprising a disc having its surface which has, at least partially, a blackening coating containing a metal, according to the invention, the blackening coating comprises a sintered porous composition of titanium grains, mainly of the dendtritic structure, of a size from 0.5 to 150 μm, and at least one high-melting metal having a melting point where 2500° C., the quantity of the high-melting metal in the composition amounting to from 5 to 60% by mass. In case the anode disc is made of a high-melting metal, the high-melting metal used for the coating is preferably the high-melting metal of the anode disc.

The radiation factor of the surface of a rotary anode of an X-ray tube is known to depend on colour and roughness of its surface as well as porosity of the surface layer.

The presence of a coating consisting of metal components only on the surface of a rotary anode according to the invention makes it possible to impart to the surface a colour which is darker than the colour of a surface coated with oxides ($Al_2O_3$ and $TiO_2$).

The surface made up of a sintered metal composition exhibits a substantially higher radiation factor as compared with the surface of fused oxides since structure and physico-mechanical characteristics of the components of the composition are not impaired during sintering at temperature which do not exceed 1200° C.

In addition, according to the invention, the radiation factor of the surface of the rotary anode is improved owing to higher roughness and porosity of the surface layer due to the dendritic structure of titanium grains which is characterized by irregular shape with a large surface area and a large number of points in contact with each other, the titanium grains being bounded to each other, to the high-melting material and material of the disc at these points during sintering.

To prolong service life and increase power of an X-ray tube, the rotary anodes according to the invention are preferably used in the X-ray tubes.

Use of the rotary anode according to the invention in an X-ray tube allows service life to be prolonged and power of the X-ray tube increased by 1.3–1.6 times owing to a decrease in the anode temperature during operation of the tube which is achieved by improving the radiation factor of the anode coating. On the other hand, lowering the anode temperature allows the thickness, hence the mass of the rotary anode to be reduced, for a given rated power of the X-ray tube so as to reduce load on bearings, prolong their service life and service life of the tube as a whole.

Service life of an X-ray tube having the rotary anode according to the invention is also prolonged owing to a high strength of the blackening coating which is capable of withstanding without destruction high mechanical loads (rotation at a speed of 9000 rpm and higher) and high thermal loads (1000° C.).

Additional advantages of the invention are as follows:

ability of the coating to improve vacuum conditions in an X-ray tube which also contributes to a prolongation of its service life;

higher efficiency of use of X-ray equipment owing to a shorter time necessary for cooling down the anode and reduction of downtimes;

lower manufacturing cost of the rotary anode, hence of the tube as a whole owing to a lower metal weight of the anode which is made of expensive materials.

The invention will now be described with reference to specific embodiments illustrated in the accompanying drawings, in which.

PREFERRED EMBODIMENT OF THE INVENTION

Figure 1:
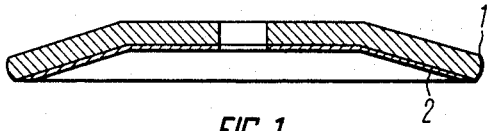
FIG. 1 is a transverse section of a rotary anode for an X-ray tube according to the invention.

A rotary anode for an X-ray tube shown in FIG. 1 comprises a disc 1 having a blackening coating 2 on its surface. The coating 2 may be applied to a part of the surface of the disc 1 as shown in FIG. 1, or may be applied to the entire surface except for a focus path region.

The coating 2 is in the form of a sintered porous composition of titanium grains, mainly of dendritic structure, of a size from 0.5 to 150 μm, and at least one high-melting metal having a melting point above 2500° C., the quantity of the high-melting metal in the composition amounting to from 5 to 60% by mass.

This sintered composition is characterized by a high strength with dimensional stability and unchanged characteristics of the starting components. High porosity and strength of the coating 2 are also due to the fact that titanium grains of diverse size from 0.5 to 150 μm are used for preparing the composition.

In case the titanium grain size is smaller than 0.5 μm the porosity of the coating 2 is lower as the grain shape becomes closer to the spherical configuration which features a more compact structure.

On the other side, with a titanium grain larger than 150 μm particles of the coating 2 may separate from the anode if the latter rotates at a high speed (9000 rpm and higher).

At the same time, strength of the coating 2 is also very important for the anode parameters, and this strength is also improved due to the correspondence between physico-mechanical properties of the materials of the disc 1 and coating 2, and in particular, the correspondence of their coefficients of thermal expansion. This is achieved by using the coating 2 consisting of metals only and by employment of a high-melting metal in the composition of the coating.

uUse of a high-melting metal having a melting point above 2500° C. in the coating provides for a good cohesion between the material of the coating 2 and anode since the anode material is generally also a high-melting metal having a melting point above 2500° C. In such case, the high-melting metal in the composition of the blackening coating 2 is the metal of which the disc 1 of the anode is made. For example, if the anode disc 1 is made of tungsten, tungsten is also used as the high-melting metal for the coating. In case the disc 1 of the anode is composite or is made of high-melting metal alloys, it is preferred to use in the composition of the blackening coating 2 mixtures of high-melting metals in combination with titanium so to ensure physico-mechanical characteristics of the coating 2 corresponding to the physico-mechanical characteristics of the material of which the anode disc 1 is made. For example, if the anode disc 1 is made of molybdenum and tungsten, the blackening coating should contain molybdenum and tunsten as the high-melting componenets.

In addition, use of the high-melting component makes it possible to treat the anode at a temperature up to 1200° C. as to create conditions for producing a strong coating withstanding the anode speed of 9000 rpm and higher.

The presence in the composition of a high-melting metal prevents titanium grains from fusing so as to produce a highly porous structure of the anode surface. It should be noted that in case the composition contains less than 5% by mass of a high-melting metal, titanium grains may fuse in operation of an X-ray tube thus resulting in impaired porosity, hence, impaired blackening properties of the surface layer of the rotary anode. If the quantity of the high-melting metal is greater than 60% by mass, the porosity of the coating will be mainly determined by the dendritic structure of titanium grains and will also be lowered.

Figure 2:
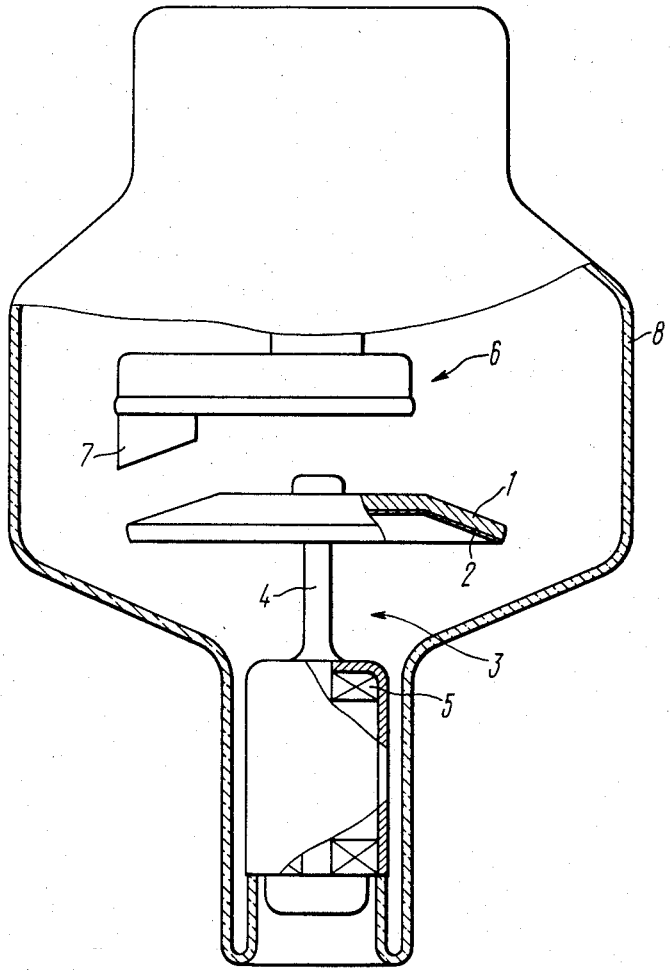
FIG. 2 is an X-ray tube, partially in section, having a rotary anode according to the invention.

FIG. 2 shows an X-ray tube having an anode assembly 3 comprising a rotary anode in the form of the anode disc 1 having the blackening coating 2, the disc being journalled with its shaft 4 in bearings 5, and a cathode assembly 6 having a cathode head 7. All the abovementioned components are enclosed in a sealed glass bulb 8.

During operation of the X-ray tube the anode assembly 3 rotates at a speed of 3000–9000 rpm and, when a filament voltage is applied to the cathode disposed in the cathode head 7, electrons are emitted and accelerated by an electric field between the anode assembly 3 and cathode head 7.

The electrons stopped at the anode disc 1 induce X-ray radiation. With a sufficiently high energy of electrons, a characteristic X-ray radiation is also excited which depends on the anode material; the anode disc 1 is thus heated to a temperature of about 1000° C.

The provision of the coating 2 on the anode disc 1 improves the radiation factor of the surface because of its rough and porous structure and dark colour of metals making up the coating, and the anode temperature is lowered to 750°–800° C. with the same operating conditions of the X-ray tube so that power of the tube may be increased.

During operation of the X-ray tube the rotary anode is subjected to high heat and mechanical loads.

Service life of X-ray tubes is mainly determined by durability of the rotary anode and service life of its bearings since service life of these parts is much lower than that of the other components. Service life of the anode is prolonged and power of an X-ray tube having such an anode is increased owing to the improvement of physico-mechanical properties of the anode surface. On the other hand, service life of the bearings of the rotary anode may be prolonged, with a given power, owing to a lower mass of the rotary anode.

A disc 1 for a rotary anode was made as shown in FIG. 1 for an X-ray tube 100 mm in diameter and 3.5 mm thick, of tungsten, and to the surface of the disc 1 was applied the coating 2 containing 70% by mass of a mixture of titanium grains, mainly of the dendritic structure, consisting of grains of a size from 5 to 150 μm, and 30% by mass of tungsten.

For producing the coating 2, a mixture of starting components was thoroughly mechanically stirred and was applied to the surface of the disc 1 by any appropriate known method. The anode disc 1 with the applied coating 2 was then placed into a vacuum furnace which was evacuated to a pressure of maximum $1.3 \cdot 10^{-3}$ Pa, and then a gradual temperature rise was effected in the furnace.

During heating, a constant control of pressure in the vacuum furnace was effected, the pressure value being under $1.3 \cdot 10^{-1}$ Pa during the temperature rise. When the tempeature of 800° C. was achieved, the furnace was evacuated to a pressure of maximum $1.3 \cdot 10^{-2}$ Pa. During further temperature rise to 1000° C., at which the coating was sintered, pressure in the vacuum furnace did not exceed $1.3 \cdot 10^{-3}$ Pa. After cooling and removal from the furnace, the anode had a smooth rough dark-gray surface.

The porosity of the resultant coating as measured by the weighing method was 68%.

The radiation factor of the resultant coating was determined by the Stefan-Boltzmann law and was 0.7.

Other embodiments of the invention and test results are given in the comparison Table (porosity and radiation factor) showing properties of the blackening compositions for coating the discs of tungsten, molybdenum and RTM (rhenium, tungsten, molybdenum).

Depending on specific requirements imposed on X-ray tubes, the anode disc 1 may have the coating according to the invention provided on any part of the surface or over the entire surface except for a focussing strip.

The manufacture of the anode according to the invention allowed its temperature during operation of the X-ray tube to be lowered by 200°–300° C. as compared with the anode without coating and by 100°–150° C. as compared with the anode having a coating of the compounds of the type of $Al_2O_3$ or $TiO_2$.

TABLE

Comparison of Properties (Porosity and Radiation Factor) of Blackening Coatings of Various Compositions on Discs

| Rotary anode disc material | Coating composition in % by mass | Radiation factor, E | Porosity, % |
|---|---|---|---|
| W | Ti - 95<br>W - 5 | 0.65 | 64 |
| W | Ti - 70<br>W - 30 | 0.70 | 68 |
| W | Ti - 40<br>W - 60 | 0.60 | 61 |
| Mo | Ti - 70<br>Mo - 30 | 0.69 | 68 |
| RTM | Ti - 70<br>W - 15<br>Mo - 15 | 0.68 | 68 |

Comparative tests of X-ray tubes having the anodes coated with oxides and the anodes made according to the invention under various X-ray examination conditions showed that the rated power of the X-ray tubes having the anodes according to the invention was 1.3–1.6 times higher.

During tests of the X-ray tubes under X-ray examination conditions with sighting shots, the anode temperature according to the invention was made equal to that of the anode having the oxide coating, and then a number of photographs were made. After the third shot, the temperature of the anode according to the invention was stabilized and did not exceed the temperature setup before starting the series of shots. At the same time, the temperature of the anode having the oxide coating increased which resulted in the need to suspend operation of the X-ray tubes at regular intervals for cooling them down.

Use of the anodes according to the invention makes it possible to employ X-ray tubes having a rotary RTM anode of a mass of 0.7 kg rotating at the speed of 9000 rpm for the purposes of diagnostic tomography.

After the tests of the X-ray tube having the rotation anode according to the invention, to determine service life, the tube was opened to assess quality of coating of the rotary anode.

The microscopic investigation showed absence of mechanical damages and fusion of the coating.

INDUSTRIAL APPLICABILITY

The X-ray tubes with the rotary anode according to the invention may be used in the medicine for diagnosis and tomography and also in various industries such as mechanical engineering, instrumentation engineering, metallurgy and in other industries for flaw detection.

Owing to the abovementioned advantages, the invention may be used in any devices having components the surface of which of to exhibit heat radiation properties.

We claim:

1. A rotary anode for an X-ray tub comprising a disc and a blackening coating on at least a part of a surface of the disc, the blackening coating comprising a sintered porous composition of titanium grains having an essentially dendritic structure of a size from 0.5 to 150 μm, and at least one high melting point metal having a melting point greater than 2500° C.. the amount of the high melting point metal in the coating being between about 5 and 60% by weight.

2. A rotary anode for an X-ray tube according to claim 1 wherein the disc is made of the same high melting point metal which is used in the coating.

3. An X-ray tube comprising a rotary anode in the form of a metal disc and a blackening coating, said blackening coating being more porous than the disc on at least part of a surface of the disc, the coating comprising a sintered porous composition of titanium grains having an essentially dendritic structure with a size of 0.50 to 150 μm, and at least one high melting point metal having a melting point above 2500° C., the amount of the high melting point metal in the coating being between about 5 and 60% by weight.

* * * * *